United States Patent [19]

Salamon et al.

[11] Patent Number: 4,744,540

[45] Date of Patent: May 17, 1988

[54] CASTING MOLD FOR MANUFACTURING GRID PLATES FOR LEAD BATTERIES

[75] Inventors: Klaus Salamon, Kelkheim; Bernhard Kallup, Aschaffenburg, both of Fed. Rep. of Germany

[73] Assignee: Varta Batterie Aktiengesellschaft, Hanover, Fed. Rep. of Germany

[21] Appl. No.: 906,739

[22] Filed: Sep. 11, 1986

[30] Foreign Application Priority Data

Sep. 20, 1985 [DE] Fed. Rep. of Germany ..... 3533581

[51] Int. Cl.[4] ..... B22D 25/04

[52] U.S. Cl. ..... 249/60; 164/138; 249/102; 249/113; 249/134; 249/141

[58] Field of Search ..... 249/60, 102, 111, 112, 249/113, 114, 115, 134, 135, 141; 164/138, 72, 33; 264/127

[56] References Cited

U.S. PATENT DOCUMENTS

| | | | |
|---|---|---|---|
| 2,882,568 | 4/1959 | Leaberry et al. | 249/114 |
| 3,023,468 | 3/1962 | Hord et al. | 249/113 |
| 3,534,803 | 10/1970 | Bickerdike et al. | 164/138 |
| 3,761,047 | 9/1973 | Mao | 164/72 |
| 3,933,335 | 1/1976 | Maruyama et al. | 249/114 |
| 4,031,283 | 6/1977 | Fagan | 264/127 |
| 4,196,769 | 4/1980 | Feagin | 249/134 |
| 4,614,630 | 9/1986 | Pluim, Jr. | 249/114 |

FOREIGN PATENT DOCUMENTS

| | | | |
|---|---|---|---|
| 0065996 | 12/1982 | European Pat. Off. | 249/60 |
| 2520993 | 4/1975 | Fed. Rep. of Germany | 164/72 |
| 2362800 | 4/1978 | France | 164/138 |
| 56-134047 | 10/1981 | Japan | 164/72 |
| 1177026 | 9/1985 | U.S.S.R. | 164/138 |

OTHER PUBLICATIONS

Shand, E. B., *Glass Engineering Handbook*, 2nd ed., McGraw-Hill Book Co., Inc., New York, NY, (1958), pp. 375–380, 388, and 389.

*Primary Examiner*—Jay H. Woo
*Assistant Examiner*—James C. Housel
*Attorney, Agent, or Firm*—Weiser & Stapler

[57] ABSTRACT

A casting mold for manufacturing grid plates for lead batteries makes use of easily interchangeable mold inserts for each half of a two-part, external metallic mold holder. The mold inserts are made of a highly porous microfiber nonwoven material, and render unnecessary the conventional cork-flour coating of casting molds due to good thermal insulating properties, high permeability to air and non-wettability by lead. The casting mold inserts are manufactured in a process which involves fixing of the nonwoven material with a curable binder either during or after shaping of the negative for the grid plate, so that the resulting parts assume a cardboard-like consistency.

8 Claims, 1 Drawing Sheet

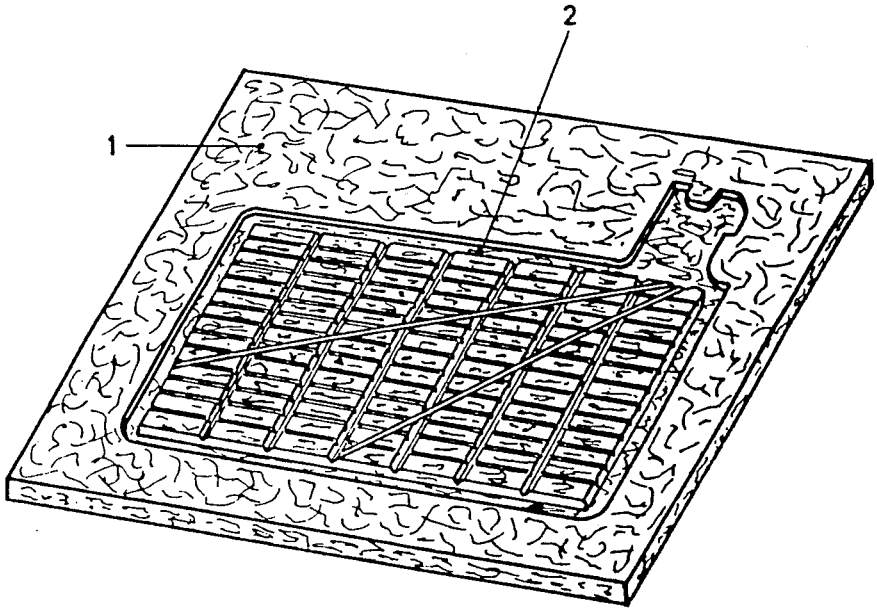
2
1

CASTING MOLD FOR MANUFACTURING GRID PLATES FOR LEAD BATTERIES

BACKGROUND OF THE INVENTION

The present invention relates generally to two-part casting molds for manufacturing grid plates for lead batteries, and in particular, to casting mold inserts for use with an external, metallic mold holder.

Casting molds of this type have only recently become known. For example, EP-PS No. 65,996 discloses the preparation of a ceramic coating for a metallic casting mold (made of cast iron) to eliminate the previously required, and generally cumbersome powdering with cork flour. In connection with this disclosure, there is described the formation of interchangeable mold linings (i.e., as separate inserts) formed of ceramic materials. The metallic casting mold acts as a holder for the ceramic mold inserts.

Both the coating of metallic casting molds with cork flour or a black wash, which is still common practice, as well as the lining of cast-iron mold halves with a ceramic material, have as their primary task thermal insulation of the lead melt from the metallic mold which receives it, while maintaining good thermal conductivity. This serves to prevent premature solidification of the lead melt during the pouring procedure, before all of the cavities of the mold have been filled. These measures also allow air to be displaced during the filling process and to escape from the mold cavity, as well as to assure satisfactory removal of the solidified casting from the mold due to its non-wettability. The requirements imposed on an insert having a shaped parting layer consequently include high thermal insulation capacity along with high temperature stability, porosity and non-wettability by the molten lead (or lead alloys).

Ceramic inserts have been found to generally meet these requirements. The stability in shape which is inherent in ceramic materials is especially advantageous in connection with the casting of very fine grid plates with filigree-like structures. Long useful-lives corresponding to a few thousand castings can be expected with such inserts. However, such inserts are manufactured from individual ceramic foils which are cut, laminated together, pressed by a heatable die, and finally sintered above 1000° C., and are therefore rather expensive.

SUMMARY OF THE INVENTION

It is therefore the primary object of the present invention to replace the conventional cork-flour coatings for grid-casting molds by providing shaped inserts having insulating abilities which equal those of cork flour, but at a greater economy.

This and other objects are accomplished according to the present invention by providing a mold insert for use in association with an external, metallic mold holder, which is made of a highly porous, nonwoven mineral fiber material. It has been found that a nonwoven material made of appropriate microfibers is highly porous and is an ideal insulator due to the high percentage of air which it contains, thus meeting the requirement concerning heat insulation. Venting of the mold is also ensured due to the high air-permeability of the nonwoven material.

For further detail regarding the casting mold of the present invention, reference is made to the detailed description which follows, taken in connection with the accompanying FIGURE showing a preferred embodiment casting mold.

DETAILED DESCRIPTION OF A PREFERRED EMBODIMENT

The FIGURE shows a grid-casting mold according to the present invention. Generally, the negative (reliefed) half 2 of a starter grid is impressed in a cardboard-like, nonwoven plate 1 (e.g., by means of a press die). A particularly favorable casting mold is obtained if the fiber material used is borosilicate glass. In such a glass, part of the silica is replaced by boron oxide and alumina. The boron oxide serves to reduce the expansion coefficient of the glass, and consequently, its sensitivity to rapid heating and cooling. The fact that lead does not wet borosilicate glass is of particular significance since this develops an excellent parting layer, thereby facilitating removal of the casting from the mold. The borosilicate glass fibers should have diameters of from 0.5 to 10 μm.

The technical requirements for a casting mold according to the present invention are also met when an ordinary soda glass is used as the fiber material. The soda glass fibers should have a diameter of from 2 to 10 μm. Besides glass, plastics which are highly heat resistant, such as polytetrafluorethylene (Teflon), or even graphite, can also be considered for use as the base material for the casting mold.

To be noted is that the highly porous nonwoven fiber mold inserts according to the present invention do not require any further surface treatment, either with a mold release agent or an insulating material, for use in metal casting.

The following is a preferred procedure for manufacturing nonwoven fiber mold inserts according to the present invention, as a negative shape for developing a desired grid casting. A mixture of microfibers is suspended in water, so that a homogeneous fiber suspension is obtained. The suspension, which is comparable to the pulp obtained in the paper-making process, is then placed on a screen supporting the positive shape of a grid mold half. The suspension is then skimmed off making use of the screen. During dewatering of the pulp (suspension), the positive shape of the grid mold half is received in the nonwoven microfiber material which is formed, similar to the water-mark in a paper. The dried nonwoven material is fixed with a fiber while still on the screen so that it takes on a cardboard-like stiffness, readying the insert for use as a casting mold half. The second mold half is manufactured in the same manner.

The two nonwoven fiber mold halves are then inserted into the corresponding halves of a partitioned, external, metallic mold holder, and are then fixed in place. The metal mold itself, the role of which is actually that of a mold holder, is provided with vent slits, heating and cooling devices, as well as means for temperature control, in the usual manner.

In a modified manufacturing process according to the present invention, highly hardened inserts made of a nonwoven fiber material can be obtained by skimming off the suspension (without using the above-mentioned screen), and by then pressing the dewatered pulp with a pressing die having the positive shape of the desired grid casting while a binder is simultaneously added during the pressing process. After complete hardening of the binder, the negative mold is precisely fixed in the cardboard-like nonwoven material.

The resulting microfiber nonwoven molds are not devoid of wear, but can rapidly be replaced by another mold pair. Thus, this limited useful-life is of little importance in view of the very simple and inexpensive manufacture of such mold inserts. In contrast, the present invention has the advantages that the "mold coating" is no longer a function of manual skill or the care of the foundryman, that it is possible to maintain close tolerances for the casting due to the easy interchangeability of worn-out molds, and that it is possible to quickly change over to another grid type (the changeover taking only minutes).

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A casting mold for manufacturing grid plates for lead batteries including a mold insert and an external metallic mold insert holder receiving said insert, said mold insert being made of a highly porous, non-woven fiber material having a relief impression in a surface thereof for casting said grid plates, and said insert holder being capable of interchangeably receiving inserts having varying relief impressions therein.

2. The casting mold of claim 1 wherein the fiber material is a borosilicate glass.

3. The casting mold of claim 2 wherein the fibers have a diameter of from 0.5 to 10 $\mu$m.

4. The casting mold of claim 1 wherein the fiber material is a soda glass.

5. The casting mold of claim 4 wherein the fibers have a diameter of from 2 to 10 $\mu$m.

6. The casting mold of claim 1 wherein the fiber material is made of a highly heat-resistant substance.

7. The casting mold of claim 6 wherein the substance is polytetrafluorethylene.

8. The casting mold of claim 7 wherein the fiber material is graphite.

* * * * *